United States Patent [19]

Haley

[11] 4,350,279

[45] Sep. 21, 1982

[54] BATTEN SETTER

[76] Inventor: Norman S. Haley, 4016 Mapleton Dr., Chantilly, Va. 22021

[21] Appl. No.: 124,848

[22] Filed: Feb. 26, 1980

[51] Int. Cl.[3] ..... B27F 7/02; B43I 13/00; E04F 21/26

[52] U.S. Cl. ..... 227/156; 52/345; 52/749; 52/750; 269/904; 269/43; 269/254 CS; 227/110

[58] Field of Search ..... 33/180 R; 52/127, 344, 52/345, 349, 365, 749, 750, DIG. 1; 227/155, 156, 111, 110; 269/33, 43, 254 CS, 904

[56] References Cited

U.S. PATENT DOCUMENTS

| | | | |
|---|---|---|---|
| 824,777 | 7/1906 | Brooks | 269/904 X |
| 2,562,287 | 7/1957 | Webster | 227/110 X |
| 2,686,959 | 8/1954 | Robinson | 269/43 X |
| 2,703,594 | 3/1955 | Slinkard | 269/254 CS X |
| 2,818,095 | 12/1957 | Stahl et al. | 269/254 CS X |
| 3,817,438 | 6/1974 | Raab | 227/152 |
| 3,888,477 | 6/1975 | Tate | 269/904 X |
| 4,225,074 | 9/1980 | Jacobson | 227/111 X |
| 4,237,614 | 12/1980 | Williams | 269/904 X |

*Primary Examiner*—Paul A. Bell

*Attorney, Agent, or Firm*—Birch, Stewart, Kolasch & Birch

[57] ABSTRACT

A batten setter for laying batten strips on a surface at a predetermined distance from each other which comprises a first end portion and a second end portion, said first and second end portions being connected together by at least one adjustable frame member so that the distance between said first and second end portions can be varied depending upon the desired distance between adjacent batten strips, each of said end portions including first and second spaced apart, spring-biased, guide frames which are adapted to be held in said spaced apart, spring-biased position by one of said batten strips.

14 Claims, 7 Drawing Figures

BATTEN SETTER

BACKGROUND AND SUMMARY OF THE INVENTION

Field of the Invention

The present invention is directed to a Batten Setter for laying batten strips on a surface at a predetermined distance from each other. More particularly, the present invention is directed to the laying of any type of strips, for example, batten strips or fur strips on any type of surface where it is desired to provide a uniform distance between said strips which are used as a subsurface for attaching wallboard, tile, e.g., montray tile, spanish tile, shingle tile, and the like thereto.

When it is desired to apply certain types of shingle to a house or like structure, it is necessary to provide batten strips uniformly along the surface of the roof in order to produce a suitable surface to which the tile can be attached. Obviously, in order to provide the necessary uniformity in the laying of this tile, it is necessary that the distance between adjacent batten strips be accurately determined so that the application of the tile to the batten strips, for example, the nailing of the tile to the batten strips, can be readily effected. Similarly, when furring out a wall for the subsequent application of wallboard, paneling, and the like, it is also necessary to provide furring strips along the wall at predetermined distances from each other. In the past, when either applying furring strips along a wall or batten strips extending longitudinally along the length of the roof of a house, it was necessary for the application of each furring strip or each batten strip to the desired surface, to accurately measure the distance between the first batten strip or fur strip and all subsequently laid batten strips or fur strips. Thus, for example, when applying batten strips to the surface of a roof, the first row of batten strips was nailed along the longitudinal edge of the roof and all subsequent rows of batten strips could not be laid without first measuring the desired distance between the first batten strip and all subsequent batten strips and making sure that this distance would remain constant as each row of batten strips was nailed along the longitudinal length of the roof. Thus, the presently used methods for laying batten strips to a roof require that continual measurements be made in order to ensure a uniform distance between adjacent batten strips.

Accordingly, an object of the present invention is to provide a batten setter for laying batten strips on a surface, for example a roof, at a predetermined distance from each other without the necessity of making a plurality of measurements.

Another object of the present invention is to provide a batten setting device which makes it relatively easy to maintain a substantially uniform distance between adjacent batten strips.

Still another object of the present invention is to provide a batten setter in combination with a nailing device, wherein after the batten strips are positioned along the desired surface, a nailer can be used to fix the batten strips to said surface.

A still further object of the present invention is to provide a device which is also effective in uniformly applying strips to a surface, such as for example attaching furring strips to a wall to be furred out, with an equal spacing provided between adjacent fur strips.

Other objects and further scope of applicability of the present invention will become apparent form the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, a device is provided for attaching batten strips or fur strips to a surface which comprises an expandable frame member which enables an operator to lay batten strips or furring strips at a predetermined distance from each other along a desired surface. The batten setter comprises a first end portion and a second end portion, said first and second end portions being connected together by at least one adjustable frame member so that the distance between said first and second end portions can be varied depending on the desired distance between adjacent batten strips or fur strips, each of said end portions including first and second spaced apart, spring-biased guide frames which are adapted to be held in said spaced apart spring-biased position by one of said batten strips.

BRIEF DESCRIPTION OF THE DRAWINGS

The present invention will become more fully understood from the detailed description given hereinbelow and the accompanying drawings which are given by way of illustration only and, thus, are not limitative of the present invention, and wherein.

DETAILED DESCRIPTION OF THE INVENTION

Figure 1:
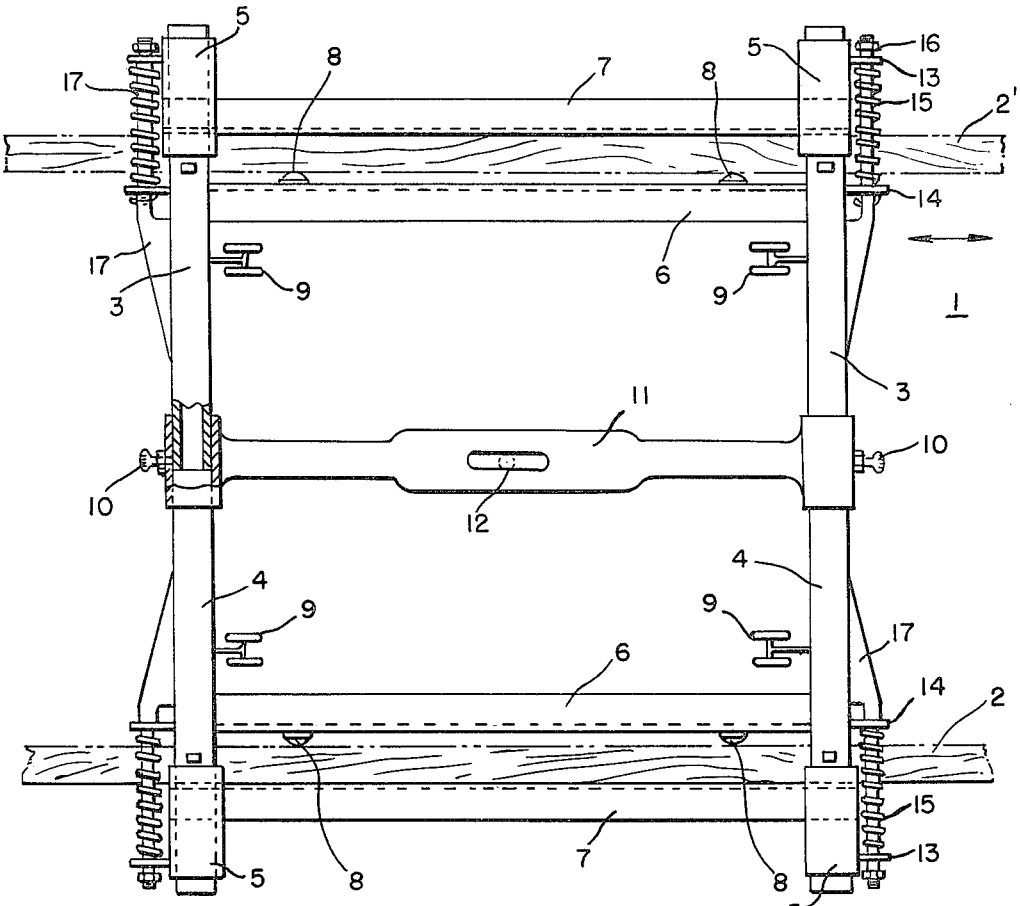
FIG. 1 shows a planned view of the batten setter of the present invention, and how it is used for positioning two adjacent batten strips relative to each other.

The present invention will now be described in greater detail with reference to FIG. 1 of the present invention wherein numeral 1 indicates the batten setter of the present invention. In attaching batten strips along the longitudinal length of the roof of a dwelling, the first batten strip is attached to the edge of the roofing by hand and extends along the longitudinal edge of the roof from one end of the dwelling to the other. At this point the batten setter of the present invention comes into play. First of all, the desired distance which is to be utilized between adjacent batten strips is selected and the telescopic arms 3 and 4 are manipulated relative to each other to position the device for establishing the desired distance between adjacent batten strips. Then the set screw 10 is tightened to hold the telescopic arms 3 and 4 in position. To facilitate the establishment of various distances between adjacent batten strips, a measuring scale can be provided on the telescopic arms.

Figure 2:
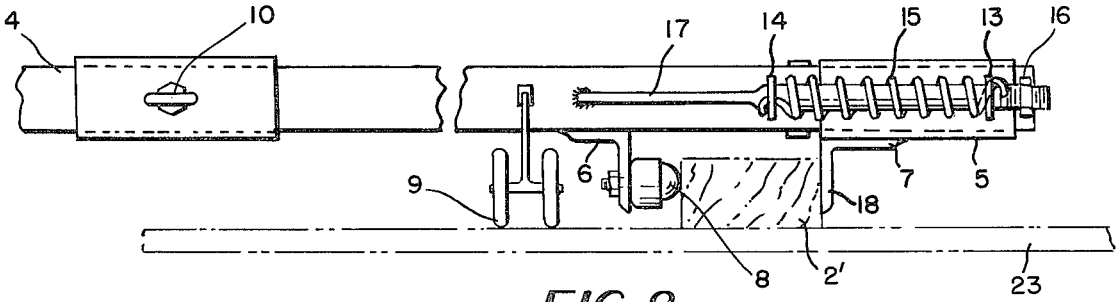
FIG. 2 shows the side view of the batten setter showing FIG. 1.
Figure 7:
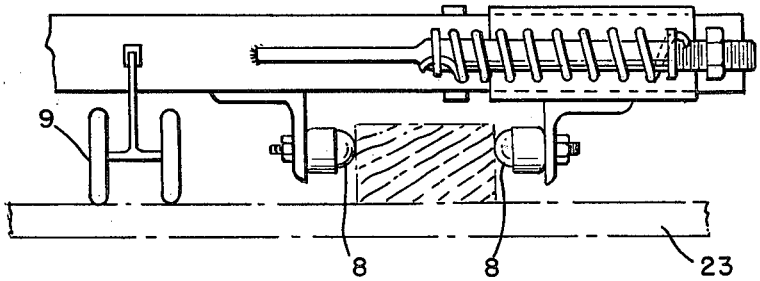
FIG. 7 shows the use of two guide rollers for guiding the batten setter.

With the batten strip 2 secured to the surface 23, the horizontal frame members 6 and 7 are placed around the batten strip 2 and held in position by the spring-bias of said horizontal frame members 6 and 7. Frame member 7 is attached to a sleeve 5 and is provided with an end plate 18 which is in sliding engagement with the batten strip 2' (see FIG. 2). Alternatively, the end plate 18 can be provided with a roller 8 (see FIG. 7) which even further facilitates the operation of the batten setter, particularly when the batten strips are warped or out of alignment. In a similar manner, the horizontal frame member 6 is attached to the telescopic member 3 or 4 and is provided with roller means 8 for slideable engagement with the batten strips 2' (see FIG. 2). The horizontal frame members 6 and 7 are provided with their respective spring-bias as a result of a spring 15 which is adapted to be compressed between members 13 and 14 by adjusting the screw member 16. Members 13 and 14 are fixed to the sleeve member 5 and the telescopic member 3 or 4, respectively. The spring member 15 is also mounted on element 17 which is a rod member attached to the telescopic member 3 or 4.

With the horizontal members 6 and 7 being held against the batten strip 2 by the spring bias of the spring 15, batten strip 2' can be held in its desired position at the other end of the batten setter by a similar arrangement of structural elements. Thus, by using the first batten strip 2 as a guide, the second batten strip 2' can be readily positioned in a desired spacing from the batten strip 2 and readily nailed into position. Thus, it is not necessary to continually measure the distance between adjacent batten strips since this distance has already been predetermined by the adjustment of the telescopic members 3 and 4. As previously stated, roller means 8 facilitate the movement of the batten setter along the batten strips 2 and 2'. To further facilitate the movement of the batten setter along the surface 23, additional roller means 9 are attached to the frame of the batten setter for engagement with the surface 23. The batten setter can also be provided with a brace member 11 which adds over all stability to the device. The brace member 11 can advantageously be provided with a handle means 12.

Figure 3:
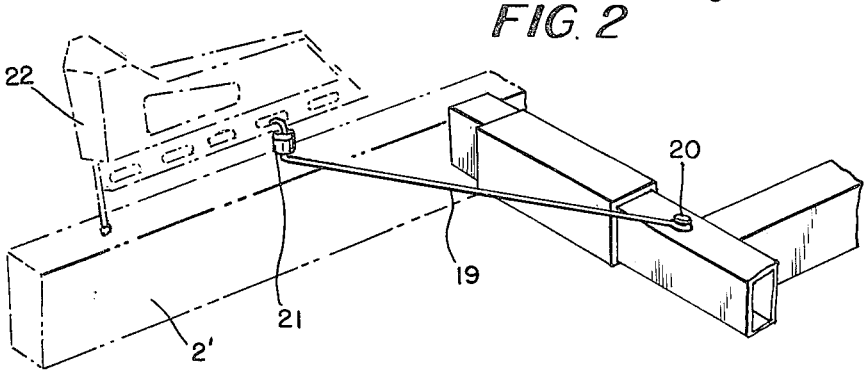
FIG. 3 shows how an automatic nailer can be attached to and used in conjunction with the batten setter of the present invention.

To facilitate the nailing of the batten strips to the surface 23 the batten setter can be advantageously provided with an automatic nailer 22, which, as shown in FIG. 3, can be attached to the batten setter by connecting arm 19 which is pivotly connected to the batten setter by pin means 20. At the other end of the connecting arm 19 is attachment means 21 which is utilized to attach the connecting arm to the nailer 22.

Figure 4:
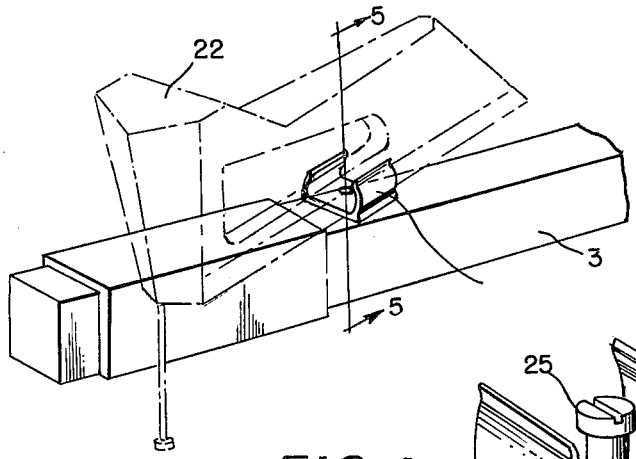
FIG. 4 is a perspective view showing a nailer pivotally attached to the batten setter.
Figure 5:
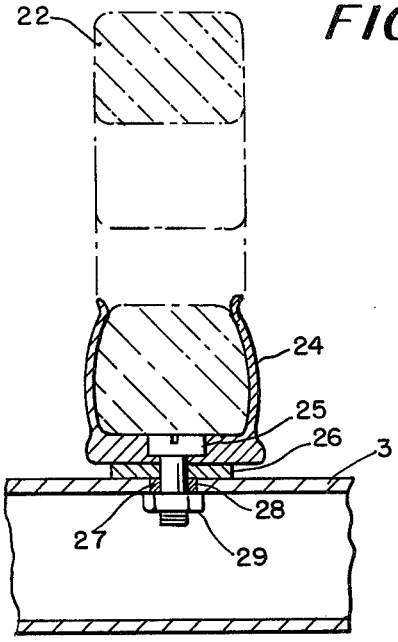
FIG. 5 is an end view taken along line 5—5 of FIG. 4.
Figure 6:
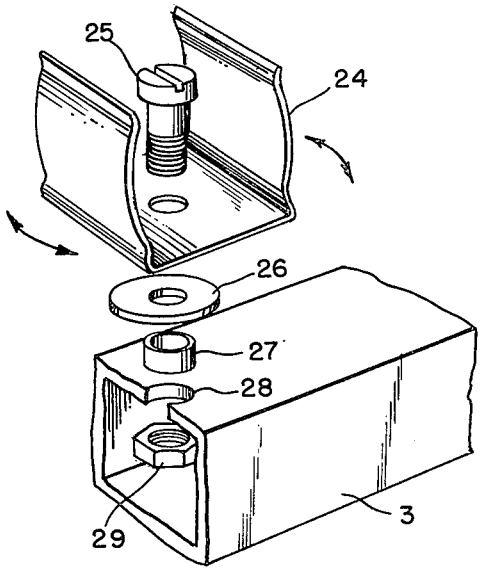
FIG. 6 shows how a clamp can be pivotally attached to the batten setter.

Although the automatic nailer 22, as shown in FIG. 3, is connected to member 3 or 4, advantageously, it can be pivotally connected directly to member 3 or 4 or to any other portion of the frame of the device by a clamp 24. In the preferred method of mounting the nailer, as shown in FIG. 4, the clamp-type holder 24 is pivotally connected to the frame member 3, on either side of the device by bolt 25, washer 26, spacer 27 and nut 29. A hole 28 is provided in the frame member 3 to facilitate the attachment. The nailer 22 is placed into the clamp 24 as shown in FIGS. 4 and 5 from where it can be turned in any direction to facilitate the nailing of the batten strip. Advantageously the opening of the clamp member 24 is biased to a size smaller than the base of the nailer so that when the nailer is inserted into the clamp, it is held firmly therein.

The batten setter of the present invention provides a device which is very effective in attaching batten strips to a surface, for example the roof of a dwelling, while providing a substantially equal distance between adjacent batten strips, in a relatively short period of time. The device of the present invention represents a substantial improvement in the present method and in fact achieves a more uniformly dimensioned result.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A batten setter which is adapted to be moved along a surface for spacing batten strips on said surface at a predetermined distance from each other which comprises a first end portion and a second end portion said first and second end portions being connected together by at least one spaced-apart, slidably adjustable frame member, so that the distance between said first and second end portions can be varied depending upon the desired distance between adjacent batten strips, said frame members connecting said end portions in substantially parallel relationships, each of said end portions including first and second spaced-apart spring-biased guide frames adapted to be positioned on opposite sides of said batten strip for clamping and sliding along said batten strip, and means for supporting the batten setter on said surface for spacing said batten strips while in said spaced-apart relationship.

2. The batten setter of claim 1 wherein the slidably adjustable frame members are disposed substantially perpendicular to the guide frames of said first and second end portions.

3. The batten setter of claim 2 wherein said slidably adjustable frame members are disposed in a telescope arrangement for varying the distance between said first and second end portions.

4. The batten setter of claim 3 wherein locking means are provided for locking the adjustable frame members in a fixed position.

5. The batten setter of any one of claims 1, 2, 3 or 4 wherein at least one of said guide frames of each of said end portions is provided with roller means which are adapted to slidably engage said batten strip.

6. The batten setter of claim 5 wherein additional roller means are attached to the device for sliding engagement with said surface.

7. The batten setter of claim 6 wherein the additional roller means are attached to the frame member.

8. The batten setter of claim 2 wherein the two adjustable frame members are connected together by a cross frame member provided with a handle means.

9. The batten setter of claims 1 or 2 wherein each of said first and second end portions further include a sleeve member slidably disposed around said frame member, said sleeve member being attached to said first guide frame and said frame member being attached to said second guide frame, said first and second guide frames being spring-biased by a spring means attached to said frame member and said sleeve member.

10. The batten setter of claim 9 wherein at least one of said first and second guide frames is provided with roller means.

11. The batten setter of claim 1 further including a nailing device attached thereto for nailing the batten strips to said surface.

12. The batten setter of claim 11 wherein a clamp means is pivotally connected to the frame of said batten setter and said nailing device is secured in said clamp means.

13. The batten setter of claim 12 wherein the clamp means is biased to a dimension smaller than the nailer and said nailer is inserted in said clamp means against said bias.

14. The batten setter of claim 1 wherein all of said guide frames are provided with roller means adapted for engagement with the batten strips.

* * * * *